US005378243A

United States Patent [19]

Lei et al.

[11] Patent Number: 5,378,243

[45] Date of Patent: Jan. 3, 1995

[54] FLAME RETARDANT AND WATER-RESISTANT TREATMENT OF FABRICS

[75] Inventors: Xiao P. Lei, Selly Oak; David W. Speake, Halesowen; Mohsen Zakikhani, Kidderminster, all of England

[73] Assignee: Albright & Wilson Limited, Warley, England

[21] Appl. No.: 135,884

[22] Filed: Oct. 13, 1993

[30] Foreign Application Priority Data

Oct. 22, 1992 [GB] United Kingdom ..... 9222190

[51] Int. Cl.[6] ..... D06M 13/322; C09K 21/00

[52] U.S. Cl. ..... 8/196; 252/608

[58] Field of Search ..... 8/196, 115.6; 558/157; 987/39, 197; 528/98, 102; 252/608

[56] References Cited

U.S. PATENT DOCUMENTS

| | | | |
|---|---|---|---|
| 4,072,643 | 2/1978 | Bost | 524/100 |
| 4,086,302 | 4/1978 | Morgan et al. | 558/157 |
| 4,134,877 | 1/1979 | Morgan et al. | 524/138 |
| 4,424,172 | 1/1984 | Halpern | 558/86 |
| 4,954,603 | 9/1990 | Takata et al. | 528/98 |

*Primary Examiner*—Arthur C. Prescott

*Attorney, Agent, or Firm*—Frishauf, Holtz, Goodman & Woodward

[57] ABSTRACT

In a method for the flame-retardant treatment of fabrics by impregnation with a condensate of a tetrakis (hydroxyorgano) phosphonium salt and, e.g., urea, the addition of one or more protonated and neutralized amines to the impregnation solution increases the efficiency of fixation of the phosphonium salt within the fibers, improves its uniform distribution within the system and leads to improved flame-retardant and water-resistant properties.

19 Claims, No Drawings

FLAME RETARDANT AND WATER-RESISTANT TREATMENT OF FABRICS

This invention relates to an improved method of treating fabrics to impart flame-retardant and water-resistant properties thereto and to a fabric treated thereby.

A known process for the flame-retardant treatment of fabrics including cellulosic (e.g. cotton) fibres consists of impregnation of the fabric with an aqueous solution of a poly(hydroxyorgano) phosphonium compound, for example, a tetrakis (hydroxyorgano) phosphonium salt. Alternatively, the poly (hydroxyorgano) phosphonium compound may comprise a condensate with a nitrogen—containing compound such as urea. Following impregnation, the fabric is dried and then cured with ammonia to produce a cured, water-insoluble polymer which is mechanically fixed within the fibres of the fabric. After curing, the polymer is oxidised to convert trivalent phosphorus to pentavalent phosphorus and the fabric is washed and dried. Fabrics treated according to the aforesaid process and garments made from such treated fabrics are sold under the Registered Trade Mark PROBAN of Albright & Wilson Limited.

We have now found that the addition of one or more protonated and neutralized amines to the impregnation solution increases the efficiency of fixation of the phosphonium compound within the fibres, improves uniform distribution of the phosphonium compound in the system, and leads to improved flame-retardant and increased water-resistant properties.

Accordingly, the present invention provides a method of treating fabrics to impart flame-retardant and water-resistant properties thereto, said method comprising impregnating the fabric with an aqueous solution including a poly(hydroxyalkyl) phosphonium compound, in which there is added to the impregnating solution one or more primary, secondary or tertiary aliphatic amines having from 12 to 20 carbon atoms, said amines having been protonated and neutralized prior to said addition.

The present invention also provides a flame-retardant and water-resistant fabric treated by the method described in the immediately-preceding paragraph.

The concentration of protonated and neutralized amine in the impregnating solution is suitably in the range 0.05% to 3% by weight, preferably in the range 0.1% to 1% by weight, especially about 0.3% by weight.

In a preferred embodiment of the present invention, the protonated and neutralized amine consists essentially of n-octadecylamine.

In an alternative embodiment of the present invention, the protonated and neutralized amine comprises a mixture of primary aliphatic amines having from 16 to 18 carbon atoms.

Suitably, the poly(hydroxyalkyl) phosphonium compound is a tetrakis (hydroxyalkyl) phosphonium (hereinafter THP) compound, for example a [THP]+ salt.

The amines are protonated and neutralized according to the present invention by means of a weak organic acid, for example acetic acid. The protonated and neutralized amine may therefore consist essentially of octadecylamine acetate.

Suitably, the amines may be obtained in an already-protonated and neutralized state.

Alternatively, the amines can simply be mixed with sufficient acetic acid to achieve protonation and neutralization and the so-treated amines added to the impregnation solution.

The present invention will be illustrated, merely by way of example, as follows:

The following fabrics were treated in accordance with the present invention:

Sample Code A

A satin fabric comprising 60% cotton fibres and 40% polyester fibres and having a weight of 280 g/m$^2$ Sample Code B A twill fabric comprising 60% cotton fibres and 40% polyester fibres and having a weight of 245 g/m$^2$ Sample Code C A twill fabric comprising 60% cotton fibres and 40% polyester fibres and having a weight of 315 g/m$^2$.

Sample Code D

A plain-weave, pigment-printed fabric comprising 100% cotton fibres and having a weight of 200 g/m$^2$ The fabrics were impregnated with an aqueous solution containing the following percentages by weight of a precondensate of tetrakis (hydroxymethyl) phosphonium chloride and urea, together with protonated and neutralized amines in accordance with the present invention, the ratio of the phosphonium chloride to urea in the condensate being 2:1 molar:

A: 42.25% by weight
B: 42.25% by weight
C: 39% by weight
D: 32.5% by weight

The impregnated fabrics were squeezed to a wet pick-up in the following ranges based upon the original weight of the fabric:

A: 80%
B: 80%
C: 80%
D: 90%

The fabrics were then dried at 120° C. and kept overnight at ambient temperature to achieve a moisture content in the range 4 to 8% , preferably 5 to 8%.

The dried fabrics were cured with gaseous ammonia to cure the precondensate within the fibres of the fabrics, followed by oxidation with hydrogen peroxide, washing and drying, TABLE I (below) shows the results of testing for flame-retardant properties according to DIN 66083 s-b:

TABLE I

| Sample Code | Direction of test | Ignition time (sec) | Afterflame (sec) | Afterglow (sec) | Char Length (mm) |
|---|---|---|---|---|---|
| A | warp | 3 | 0 | 0 | 7 |
| | | 15 | 0 | 0 | 125 |
| | | 3 | 0 | 0 | 6 |
| | | 15 | 0 | 0 | 75 |
| | | 3 | 0 | 0 | 5 |
| | | 15 | 0 | 0 | |
| | weft | 3 | 0 | 0 | 7 |
| | | 15 | 0 | 0 | 87 |
| | | 3 | 0 | 0 | 8 |
| | | 15 | 0 | 0 | 75 |
| | | 3 | 0 | 0 | 7 |
| | | 15 | 0 | 0 | 75 |
| B | warp | 3 | 0 | 0 | 20 |
| | | 15 | 0 | 0 | 110 |
| | | 3 | 0 | 0 | 13 |
| | | 15 | 0 | 0 | 103 |
| | | 3 | 5 | 0 | 70 |
| | | 15 | — | — | — |
| | weft | 3 | 0 | 0 | 12 |
| | | 15 | 0 | 0 | 95 |
| | | 3 | 0 | 0 | 15 |

TABLE I-continued

| Sample Code | Direction of test | Ignition time (sec) | Afterflame (sec) | Afterglow (sec) | Char Length (mm) |
|---|---|---|---|---|---|
| | | 15 | 0 | 0 | 82 |
| | | 3 | 0 | 0 | 20 |
| | | 15 | 0 | 0 | 103 |
| C | warp | 3 | 0 | 0 | 5 |
| | | 15 | 0 | 0 | 112 |
| | | 3 | 0 | 0 | 5 |
| | | 15 | 0 | 0 | 88 |
| | | 3 | 0 | 0 | 5 |
| | | 15 | 0 | 0 | 100 |
| | weft | 3 | 0 | 0 | 5 |
| | | 15 | 0 | 0 | 86 |
| | | 3 | 0 | 0 | 5 |
| | | 15 | 0 | 0 | 98 |
| | | 3 | 0 | 0 | 5 |
| | | 15 | 0 | 0 | 71 |
| D | warp | 3 | 0 | 0 | 15 |
| | | 15 | 0 | 0 | 76 |
| | | 3 | 0 | 0 | 10 |
| | | 15 | 0 | 0 | 70 |
| | | 3 | 0 | 0 | 10 |
| | | 15 | 0 | 0 | 75 |
| | | 3 | 0 | 0 | 10 |
| | | 15 | 0 | 0 | 70 |
| | weft | 3 | 0 | 0 | 15 |
| | | 15 | 0 | 0 | 67 |
| | | 3 | 0 | 0 | 7 |
| | | 15 | 0 | 0 | 74 |
| | | 3 | 0 | 0 | 20 |
| | | 15 | 0 | 0 | 75 |
| | | 3 | 0 | 0 | 10 |
| | | 15 | 0 | 0 | 74 |

TABLE II (below) shows the results of testing for flame-retardant properties according to NFG 07-184 and BS 6249.

TABLE II

| Sample Code | | NFP 07-184 (damaged area) $cm^2$ | BS 6249 (char length) mm | BS 6249 After-flame (sec) | BS 6249 Afterglow (sec) |
|---|---|---|---|---|---|
| A | warp | 25 | 50 | 0 | 0 |
| | weft | 26 | 50 | 0 | 0 |
| B | warp | 35 | 82 | 0 | 0 |
| | weft | 31 | 62 | 0 | 0 |
| C | warp | 36 | 40 | 0 | 0 |
| | weft | 33 | 50 | 0 | 0 |
| D | warp | 29 | 64 | 0 | 0 |
| | weft | 24 | 53 | 0 | 0 |

The results of determination of phosphorus and nitrogen content of the fabrics after 40 washing cycles at 93° C. is shown in TABLE III (below).

TABLE III

| additive solid* (%) | after NH3 cure P % | after NH3 cure N % | as finished P % | as finished N % | after washing P % | after washing N % |
|---|---|---|---|---|---|---|
| A: 0 (control) | 3.66 | 3.92 | 2.87 | 2.64 | 2.50 | 2.40 |
| 0.3 | 3.61 | 3.96 | 3.46 | 2.23 | 3.33 | 3.01 |
| B: 0 (control) | 3.69 | 4.08 | 3.15 | 2.97 | 2.82 | 2.60 |
| 0.3 | 3.68 | 4.29 | 3.63 | 3.37 | 3.24 | 2.89 |
| C: 0 (control) | 3.33 | 3.40 | 3.09 | 2.75 | 2.89 | 2.51 |
| 0.3 | 3.42 | 3.98 | 3.33 | 3.14 | 3.12 | 2.87 |
| D: 0 (control) | 3.21 | 3.89 | 2.94 | 2.94 | 2.74 | 2.51 |
| 0.3 | 3.41 | 4.40 | 3.31 | 3.28 | 3.00 | 2.84 |

*octadecylamine acetate

The water-resistance of fabrics treated according to the present invention was determined and the results are shown in TABLE IV below:

TABLE IV

| Sample | Water-resistance (cm water) |
|---|---|
| Untreated fabric (control I) | 4 |
| Treatment without protonated amine (control II) | 5 |
| Treatment with protonated amine | 16 |

The fabric used in the foregoing tests was Sample Code C (see above).

In another example, the following fabrics were treated in accordance with the present invention:

Sample Code C (As hereinbefore described).

Sample Code E

A twill fabric comprising 60% cotton fibres and 40% polyester fibres and having a weight of 240 $g/m^2$.

The fabrics were impregnated with an aqueous solution containing the following percentages by weight of a precondensate of tetrakis (hydroxymethyl) phosphonium chloride and urea, together with protonated and neutralized amines in accordance with the present invention, the ratio of the phosphonium chloride to urea in the condensate being 2:1 molar:

C: 40.95% by weight

E: 37.05% by weight

The impregnated fabrics were squeezed to a wet pick-up in the following ranges based upon the original weight of the fabric:

C: 77%

E: 99%

The fabrics were then dried at 120° C. to achieve a fabric moisture content of between 14–18%.

The dried fabrics were cured with gaseous ammonia in the following manners:

C1: In one step

C2: In two stages, one after the other

E1: In one step

E2: In two stages, one after the other

This was followed by oxidation with hydrogen peroxide, washing and drying.

Table V (below) shows the results of testing for flame-retardant properties according to DIN 66083 s-b:

TABLE V

| Sample Code | Direction of test | Ignition time (sec) | Afterflame (sec) | Afterglow (sec) | Char length (mm) |
|---|---|---|---|---|---|
| C1 | warp | 3 | 1 | 0 | 7 |
| | | 15 | 0 | 0 | 110 |
| | | 3 | 1 | 0 | 9 |
| | | 15 | 0 | 0 | 70 |
| | weft | 3 | 0 | 0 | 5 |
| | | 15 | 0 | 0 | 70 |
| | | 3 | 0 | 0 | 5 |
| | | 15 | 0 | 0 | 75 |
| C2 | warp | 3 | 0 | 0 | 5 |
| | | 15 | 0 | 0 | 65 |
| | | 3 | 1 | 0 | 5 |
| | | 15 | 0 | 0 | 60 |
| | weft | 3 | 1 | 0 | 7 |
| | | 15 | 0 | 0 | 60 |
| | | 3 | 1 | 0 | 5 |
| | | 15 | 0 | 0 | 55 |
| E1 | warp | 3 | 1 | 0 | 11 |
| | | 15 | 0 | 0 | 65 |
| | | 3 | 2 | 0 | 11 |
| | | 15 | 0 | 0 | 70 |
| | weft | 3 | 1 | 0 | 11 |
| | | 15 | 0 | 0 | 65 |
| | | 3 | 0 | 0 | 8 |

TABLE V-continued

| Sample Code | Direction of test | Ignition time (sec) | Afterflame (sec) | Afterglow (sec) | Char length (mm) |
|---|---|---|---|---|---|
| | | 15 | 0 | 0 | 75 |
| E2 | warp | 3 | 1 | 0 | 8 |
| | | 15 | 0 | 0 | 65 |
| | | 3 | 0 | 0 | 7 |
| | | 15 | 0 | 0 | 72 |
| | weft | 3 | 0 | 0 | 5 |
| | | 15 | 0 | 0 | 70 |
| | | 3 | 1 | 0 | 8 |
| | | 15 | 0 | 0 | 85 |

Table VI (below) shows the results of testing for flame-retardant properties according to NFG 07-184.

TABLE VI

| Sample Code | Direction of test | Damaged Area ($cm^2$) |
|---|---|---|
| C1 | warp | 21 |
| | weft | 23 |
| C2 | warp | 21 |
| | weft | 22 |
| E1 | warp | 27 |
| | weft | 25 |
| E2 | warp | 24 |
| | weft | 22 |

The results of determinations of the phosphorus and nitrogen content of the fabrics before and after 40 washing cycles at 90° C. with a detergent containing 5% perborate is shown in Table VII (below).

TABLE VII

| Sample | After $NH_3$ Cure | | As finished | | After washing | |
|---|---|---|---|---|---|---|
| Code | P % | N % | P % | N % | P % | N % |
| C1 | 3.53 | 3.92 | 3.47 | 3.23 | 3.28 | 3.10 |
| C2 | 3.52 | 4.42 | 3.53 | 3.39 | 3.63 | 3.43 |
| E1 | 4.01 | 4.68 | 3.66 | 3.44 | 3.65 | 3.59 |
| E2 | 3.98 | 5.00 | 3.86 | 3.70 | 3.85 | 3.76 |

In yet another example the fabrics, coded C and E, were padded with the standard mixture and dried at 120° C. to a fabric moisture content of between 9–12%. The fabrics were cured with gaseous ammonia in a one step manner, followed by heat curing at 130° C. The fabrics were then oxidised with hydrogen peroxide, followed by washing and drying. (Sample Codes were designated as C3 and E3 respectively).

The fabric (coded C) was also treated under the above conditions in large quantities in the plant (sample coded CM).

Table VIII shows the results of testing for flame-retardant properties according to DIN 66083.

TABLE VIII

| Sample Code | Direction of test | Ignition time (sec) | Afterflame (sec) | Afterglow (sec) | Char length (mm) |
|---|---|---|---|---|---|
| C3 | warp | 3 | 0 | 0 | 5 |
| | | 15 | 0 | 0 | 90 |
| | | 3 | 0 | 0 | 5 |
| | | 15 | 0 | 0 | 95 |
| | weft | 3 | 0 | 0 | 5 |
| | | 15 | 0 | 0 | 75 |
| | | 3 | 0 | 0 | 5 |
| | | 15 | a | 0 | 90 |
| CM | warp | 3 | 1 | 0 | 5 |
| | | 15 | 0 | 0 | 110 |
| | | 3 | 0 | 0 | 5 |
| | | 15 | 0 | 0 | 76 |
| | weft | 3 | 1 | 0 | 5 |

TABLE VIII-continued

| Sample Code | Direction of test | Ignition time (sec) | Afterflame (sec) | Afterglow (sec) | Char length (mm) |
|---|---|---|---|---|---|
| | | 15 | 0 | 1 | 50 |
| | | 3 | 1 | 0 | 5 |
| | | 15 | 0 | 1 | 55 |
| E3 | warp | 3 | 0 | 0 | 5 |
| | | 15 | 0 | 0 | 70 |
| | | 3 | 0 | 0 | 5 |
| | | 15 | 0 | 0 | 75 |
| | weft | 3 | 0 | 0 | 5 |
| | | 15 | 0 | 0 | 70 |
| | | 3 | 0 | 0 | 5 |
| | | 15 | 0 | 0 | 98 |

Table IX (below) shows the results of testing for flame-retardant properties according to NFG 07-184.

TABLE IX

| Sample Code | Direction of test | Damaged Area ($cm^2$) |
|---|---|---|
| C3 | warp | 28 |
| | weft | 26 |
| CM | warp | 27 |
| | weft | 25 |
| E3 | warp | 27 |
| | weft | 26 |

The results of determination of phosphorus and nitrogen content of the fabrics after 40 washing cycles at 93° C. is shown in Table X (below).

TABLE X

| Sample | After heat Cure | | As finished | | After washing | |
|---|---|---|---|---|---|---|
| Code | P % | N % | P % | N % | P % | N % |
| C3 | 3.82 | 4.04 | 3.54 | 3.21 | 3.31 | 2.91 |
| CM | 3.53 | 3.57 | 3.24 | 2.88 | 3.07 | 2.69 |
| E3 | 4.10 | 4.50 | 3.73 | 3.62 | 3.43 | 3.18 |

Fabrics treated according to the present invention may suitably consist essentially of cellulosic fibres, e.g. cotton fibres.

Alternatively, the fabrics may comprise both cellulosic and non-cellulosic fibres, for example polyamide fibres, acrylic fibres, aramid fibres, polyester fibres or polybenzimidazole fibres.

Suitably, the maximum content of non-cellulosic fibres in such a fabric is 70% e.g. the fabric may comprise 60% cotton fibres and 40% polyester fibres.

A suitable weight range for the fabrics treated according to the present invention is from 0.05 to 1.0 $kg/m^2$.

We claim:

1. A method of treating a fabric to impart flame-retardant and water-resistant properties thereto, wherein said method comprises impregnating said fabric with an aqueous solution consisting of:

(a) poly (hydroxyalkyl) phosphonium compound; and (b) at least one protonated and neutralized aliphatic amine selected from the group consisting of primary amines, secondary amines and tertiary amines, said at least one amine having from 12 to 20 carbon atoms, said at least one amine moreover having been protonated and neutralised prior to said impregnation.

2. The method or claim 1, wherein the concentration of said protonated and neutralized amine in said aqueous solution is in the range 0.05% to 3% by weight.

3. The method of claim 2, wherein said concentration is in the range 0.1% to 1% by weight.

4. The method of claim 2, wherein said concentration is about 0.3% by weight.

5. The method of claim 1, wherein said protonated and neutralized amine consists essentially of n-octadecylamine.

6. The method of claim 1, wherein said protonated and neutralized amine consists essentially of a mixture of primary aliphatic amines having from 16 to 18 carbon atoms.

7. The method of claim 1, wherein said poly(hydroxyalkyl) phosphonium compound is a tetrakis (hydroxyalkyl) phosphonium compound.

8. The method of claim 7, wherein said tetrakis (hydroxyalkyl) phosphonium compound is a tetrakis (hydroxymethyl) phosphonium salt.

9. The method of claim 1, wherein said amines are protonated and neutralized by means of a weak organic acid.

10. The method of claim 9, wherein said acid is acetic acid.

11. The method of claim 10, wherein said protonated and neutralized amine consists essentially of octadecylamine acetate.

12. A flame-retardant and water-resistant fabric treated by the method of claim 1.

13. A flame-retardant and water-resistant fabric obtained by impregnating said fabric with an aqueous solution consisting essentially of (a) a poly(hydroxyalkyl ) phosphonium compound; and (b) at least one protonated and neutralized amine selected from the group consisting of primary amines, secondary amines and tertiary amines, said at least one amine having from 12 to 20 carbon atoms.

14. The fabric of claim 13, said fabric consisting essentially of cellulosic fibres.

15. The fabric of claim 14, said fabric consisting essentially of cotton fibres.

16. The fabric of claim 13, said fabric consisting essentially of both cellulosic and non-cellulosic fibres.

17. The fabric of claim 16, wherein said non-cellulosic fibres are selected from the group consisting of polyamide fibres, acrylic fibres, aramid fibres, polyester fibres and polybenzimidazole fibres.

18. The fabric of claim 16, wherein the maximum content of said non-cellulosic fibres is 70%.

19. The fabric of claim 16, wherein said fabric consists essentially of cotton fibres and 40%, polyester fibres.

* * * * *